US007806745B2

(12) United States Patent
Hohl

(10) Patent No.: US 7,806,745 B2
(45) Date of Patent: Oct. 5, 2010

(54) APPARATUS TO ANIMATE A FLAT PICTURE OR PHOTOGRAPH

(76) Inventor: G. Burnell Hohl, 21 Driftway La., New Canaan, CT (US) 06840

( * ) Notice: Subject to any disclaimer, the term of this patent is extended or adjusted under 35 U.S.C. 154(b) by 1213 days.

(21) Appl. No.: 11/017,138

(22) Filed: Dec. 20, 2004

(65) Prior Publication Data

US 2005/0155261 A1 Jul. 21, 2005

Related U.S. Application Data

(60) Provisional application No. 60/536,803, filed on Jan. 16, 2004.

(51) Int. Cl.

| | |
|---|---|
| ***A63H 3/20*** | (2006.01) |
| ***A63H 3/28*** | (2006.01) |
| ***A63H 3/40*** | (2006.01) |
| ***A63H 3/48*** | (2006.01) |

(52) U.S. Cl. ..... 446/301; 40/416; 40/423; 446/337; 446/342

(58) Field of Classification Search ..... 40/416, 40/421, 423; 446/301, 337, 342, 343
See application file for complete search history.

(56) References Cited

U.S. PATENT DOCUMENTS

| | | | | | |
|---|---|---|---|---|---|
| 1,026,531 | A * | 5/1912 | Spery | 40/463 |
| 1,352,368 | A * | 9/1920 | Horsey | 40/421 |
| 1,764,834 | A * | 6/1930 | Gatliff | 40/421 |
| 1,781,307 | A * | 11/1930 | Veronda | 446/335 |
| 1,804,297 | A * | 5/1931 | Wintz | 40/455 |
| 1,897,918 | A * | 2/1933 | Wagenhals | 40/423 |
| 2,614,145 | A * | 10/1952 | Watkins | 310/23 |
| 2,722,777 | A * | 11/1955 | Simpson | 40/425 |
| 2,871,593 | A * | 2/1959 | Roberts | 40/457 |
| 3,246,409 | A * | 4/1966 | Taylor et al. | 40/457 |
| 4,803,796 | A * | 2/1989 | Ottinger | 40/414 |
| 4,889,027 | A * | 12/1989 | Yokoi | 84/635 |
| 6,386,942 | B1 * | 5/2002 | Tang | 446/301 |

* cited by examiner

*Primary Examiner*—John Ricci
(74) *Attorney, Agent, or Firm*—James F. McLaughlin

(57) ABSTRACT

An apparatus is provided for animating an image imprinted or otherwise disposed on a substantially flat surface, such as a photograph or a card. The image should include at least one element suitable for animation, such as the eyes and mouth of a face. The image is animated using an animation mechanism disposed behind the flat surface, which mechanism is connected by a solenoid to an element that is physically separate from the flat surface. The visible portion of the movable element is inserted from the back of the flat surface through a slit in the flat surface such that at least a portion of it is visible above the image. In the preferred embodiment, a pair of solenoids is utilized to move the element back and forth so as to create the illusion of animation to the picture. Also in the preferred embodiment, a device for playing an audio file associated with the image is provided, which device may be synchronized with the animation of the image so as to create a more lifelike appearance.

23 Claims, 7 Drawing Sheets

APPARATUS TO ANIMATE A FLAT PICTURE OR PHOTOGRAPH

RELATED APPLICATIONS

This application claims the benefit of the filing date of U.S. Provisional Application No. 60/536,803 for "Animated Photo," filed on Jan. 16, 2004 in the name of G. Burnell Hohl, and which is incorporated herein by reference.

BACKGROUND OF THE INVENTION

1. Field of the Invention

The present invention relates generally to a system and method for animating a flat picture, portrait, photograph, or drawing, and more particularly, to a system and method for animating facial features in a two-dimensional image of a face while synchronizing said animation with an audio playback so as to impart a lifelike appearance to said image.

2. Description of the Prior Art

Mechanisms for providing lifelike movements to the features on the countenance of a three dimensional object such as a doll or an action figure have long been known. For example, U.S. Pat. Nos. 4,775,352, 4,923,428, 5,823,847, 6,352,464, and 6,611,278 each describe various mechanisms for animating the eyes, mouth, and/or facial expressions on the face of a doll or other three-dimensional animated character. Typically, these devices have enabled movement of the plastic eyes and mouth of a toy, which movements are often synchronized with stored audio phrases, so that the doll or figure appears to talk in a realistic manner. There have also been various means of generating talking facial images, as described in U.S. Pat. Nos. 6,055,032 and 6,250,928, using display devices such as LCD screens, or by means of electronically generated visual images. Most, if not all, of the prior art, however, is directed to providing lifelike movement and synchronized audio to three dimensional objects. There is need for a flat, nearly two-dimensional mechanism that can fit into a thin picture frame, brochure, greeting card, etc. and animate the facial or other movements of a picture or photograph that is printed on paper, canvas, or other thin and flat material.

As shall be appreciated, the prior art fails to specifically address either the problem or the solution arrived upon by applicant.

SUMMARY OF THE INVENTION

Against the foregoing background, it is a primary object of the present invention to provide a mechanism for animating the facial features, particularly the mouth and eyes, of an image imprinted or otherwise displayed on a flat object, such as a greeting card, brochure, photograph, portrait, drawing or picture that can be hung on a wall, laid down or placed upright on a table or desk.

It is another object of the present invention to provide such a mechanism that is substantially flat in profile so as to allow the mechanism to be inserted within a picture frame or other object for retaining or mounting the flat object.

It is yet another object of the present invention to provide such a mechanism that is relatively lightweight.

It is a further object of the present invention to provide such a mechanism that further includes means to synchronize the movements of said facial features with the playback of at least one prerecorded audio phrase such that the face in the image appears to talk and blink its eyes in a lifelike manner.

It is also an object of the present invention to provide such a mechanism wherein said mechanism for animating and said audio playback may be triggered by an external stimulus, such as the proximity of a viewer, the opening of a card or brochure, the pressing of a button or the detection of light or sound.

It is yet a further object of the present invention to provide such a mechanism wherein the animation and the audio playback are both battery powered, so that the picture or photograph is portable, does not require a power cord, and may be easily carried around.

To the accomplishments of the foregoing objects and advantages, the present invention, in brief summary, comprises an apparatus for animating an image imprinted or otherwise disposed on a substantially flat surface, such as a photograph or a card. The image should include at least one element suitable for animation, such as the eyes and mouth of a face. The image is animated using an animation mechanism disposed behind the flat surface, which mechanism is connected by means of a solenoid to an element that is physically separate from the flat surface. The visible portion of the movable element is inserted from the back of the flat surface through a slit in the flat surface such that at least a portion of it is visible above the image. In the preferred embodiment, a pair of solenoids is utilized to move the element back and forth so as to create the illusion of animation to the picture. Also in the preferred embodiment, a means for playing an audio file associated with the image is provided, which means may be synchronized with the animation of the image so as to create a more lifelike appearance.

DETAILED DESCRIPTION OF THE PREFERRED EMBODIMENTS

Figure 5:
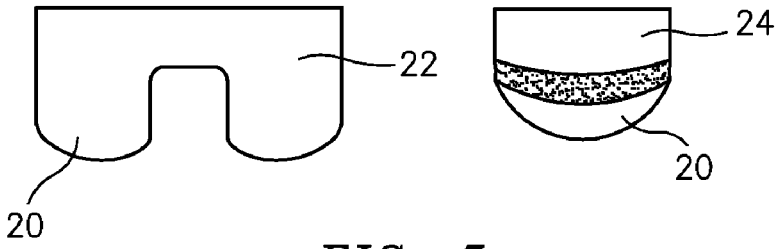
FIG. 5 is a front view of the typical cutout inserts for the eyelids and mouth/lower lip of the picture of FIG. 4.
Figure 6:
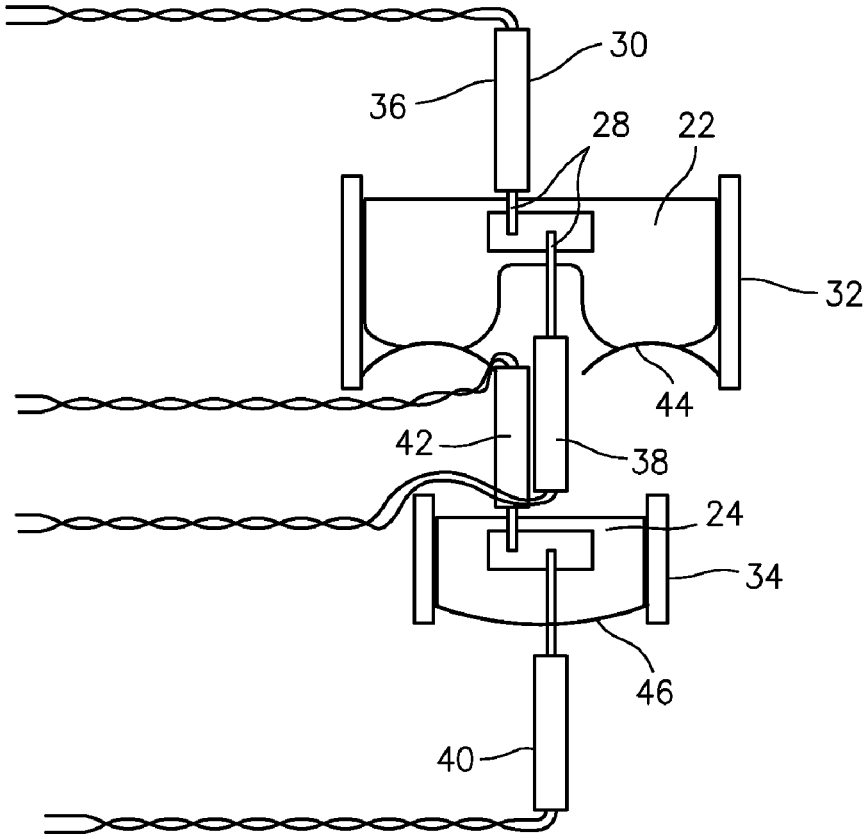
FIG. 6 is a rear view of the solenoid-driven animation mechanism of the present invention.

Referring to the drawings and, in particular, to FIG. 6 thereof, the apparatus for animating a flat picture or photograph is provided and is referred to generally by reference numeral 10. The apparatus 10 comprises a animation mechanism 12 which is situated behind a picture or photograph 14 for moving the eyelids 16 and the mouth 18 of the individual featured in the photograph 14 to thereby create lifelike movement thereto. The eyelids 16 and mouth 18 of the individual each comprise inserts 20, specifically an eyelid insert cutout 22 and a mouth/lip insert cutout 24, as illustrated in FIG. 5, which inserts 20 are shaped and made to look like the eyelids and the inside of the mouth and lower lip of the individual featured in the picture 14. The inserts 20 are inserted from behind the picture 14 through slits cut at the top of the eyes and the mouth of the individual featured in the picture 14. It should be appreciated that the eyelid insert cutout 22 is a single piece having the image of the two eyelids 16 disposed or imprinted thereon, while the mouth/lip insert cutout 24 includes the image of the lower lip and/or tongue of the individual such that when said mouth/lip insert cutout 24 is moved up and down, it appears the individual pictured in the photograph 14 is talking.

In the preferred embodiment, the inserts 20 are made from paper or other suitable lightweight and thin material having enough elasticity to enable them to be inserted from behind the picture 14 so as not to distort the picture 14 significantly.

Figure 1:
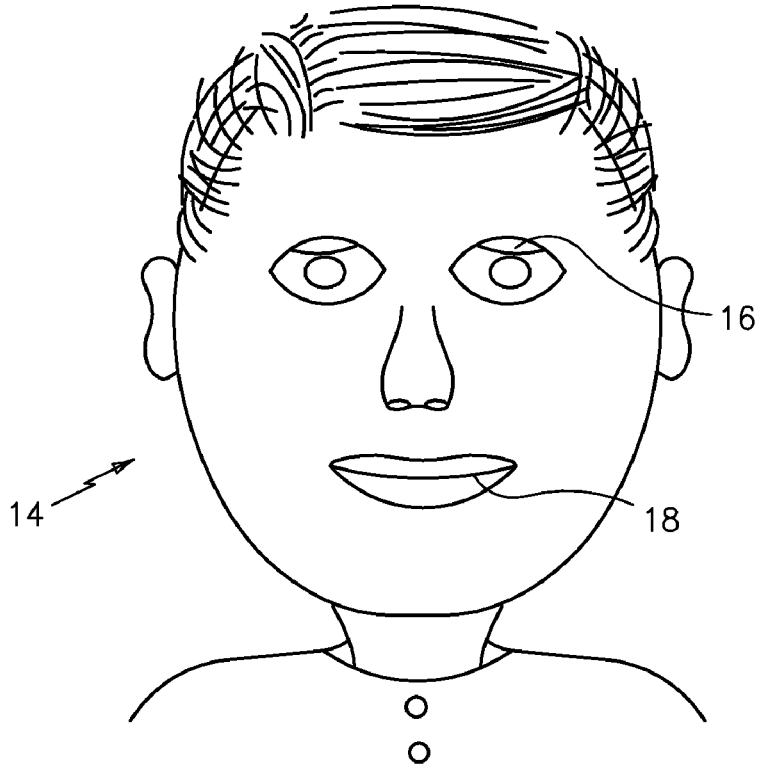
FIG. 1 is an illustration of a face, which may represented in various forms on a picture, card, photograph, portrait, or on a life-size cardboard cutout, for example, wherein the eyes are open and the mouth is closed.
Figure 2:
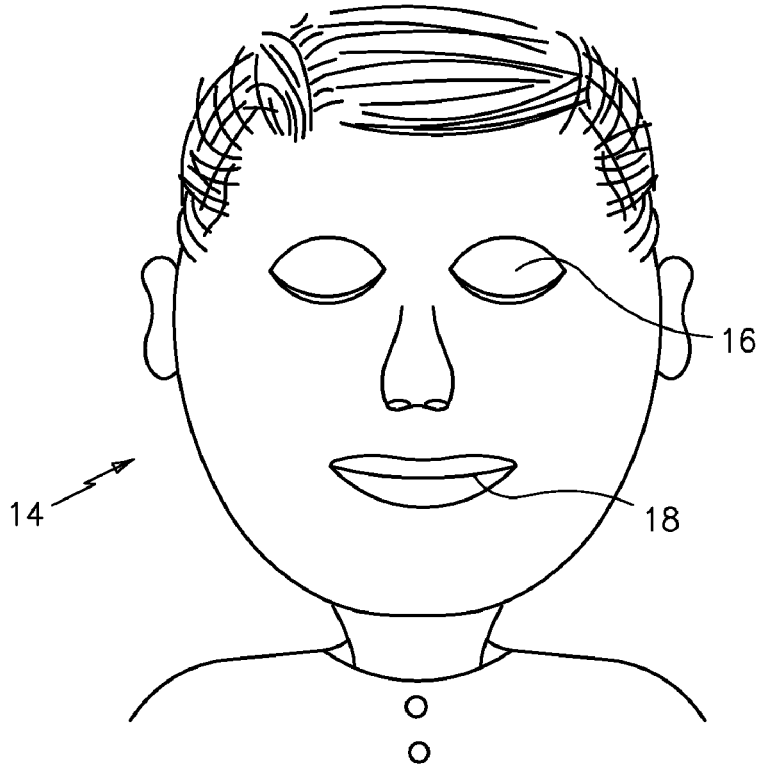
FIG. 2 is an illustration of the face of FIG. 1, wherein the eyes are closed, as when a person blinks, and the mouth is closed.
Figure 3:
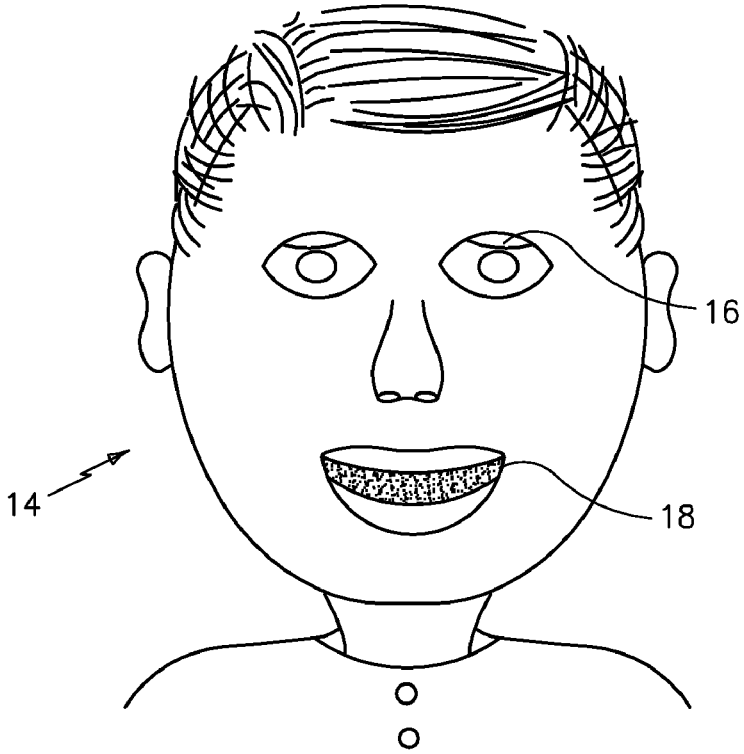
FIG. 3 is an illustration of the face of FIG. 1, wherein the eyes are open and the mouth is open, as when a person talks.
Figure 4:
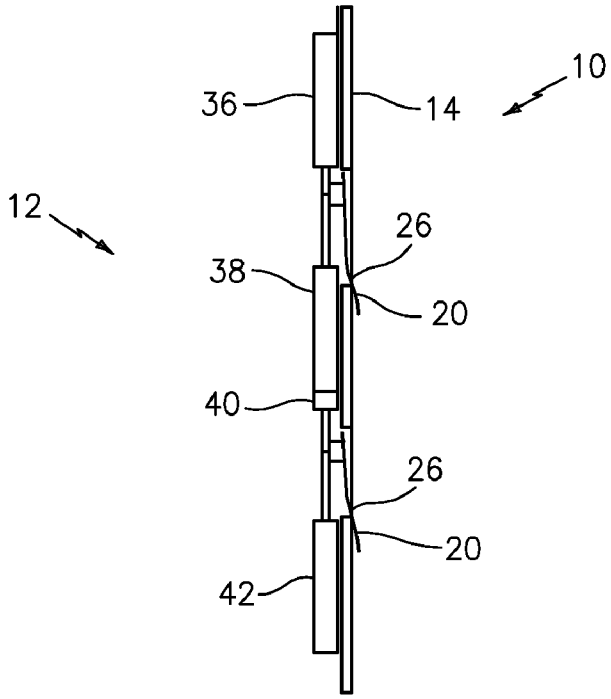
FIG. 4 is a side view of the solenoid-driven animation mechanism of the present invention installed behind the plane of the picture or photograph.

Referring again to FIG. 6, the inserts 20 are attached at the back of the picture 14 to rods 28 inserted into the cores of miniature solenoids 30, one above and one below each slit 26 in the picture. In the preferred embodiment, the rods 28 are very small and composed of a ferrous metal. When activated, the solenoids 30 pull the inserts 20 up or down by a fixed linear displacement. Optional eyelid insert guides 32 and mouth/lip insert guides 34 may be provided so as to limit and direct the movement of the inserts 20, which guides 32, 34 are essentially parallel tracks or edges which separated by the width of the inserts 20. A pair of solenoids 30 is provided for the eyelid insert cutout 22—an eyelids open solenoid 36 and an eyelids closed solenoid 38, and another pair of solenoids 30 is provided for the mouth/lip insert cutout 24—a mouth/lips open solenoid 40 and a mouth/lips closed solenoid 42. By activating the appropriate solenoids 30, the eyelids 16 and mouth 18 of the individual featured in the picture 14 appear to move down and up as viewed from the front of the photograph 14. Illustrated in FIGS. 1-3 are faces in a photograph 14 having the apparatus 10 of the present invention in which the eyelids 16 and mouth 18 are alternatively opened and closed, as when the individual might be talking or blinking.

In the preferred embodiment, the solenoids 30 in the animation mechanism 12 are approximately ⅝" long, made from approximately 400 turns of number 32 or 34 gauge enameled magnet wire, wound around a 1/16" diameter air core, although other solenoid dimensions are also useable. It is possible to employ only two spring-loaded solenoids in the animation mechanism 12 by mounting a single solenoid 30 below the eyelid slits 44 and another below the mouth slit 46 at the back of the picture 14. In this embodiment, when the solenoids 30 are not energized, springs return the eyelid and mouth/lip inserts to their idle (raised) positions. Because the solenoids 30 are so tiny, however, they are capable of exerting only a very small force and therefore it is advantageous to limit the amount of friction and drag, and the required force necessary to slide the inserts 20. The use of four solenoids 30 eliminates the necessity to overcome spring tension and permits independent control of the dwell time of the eyelids 16 and the mouth 18 in the lowered position.

Figure 8:
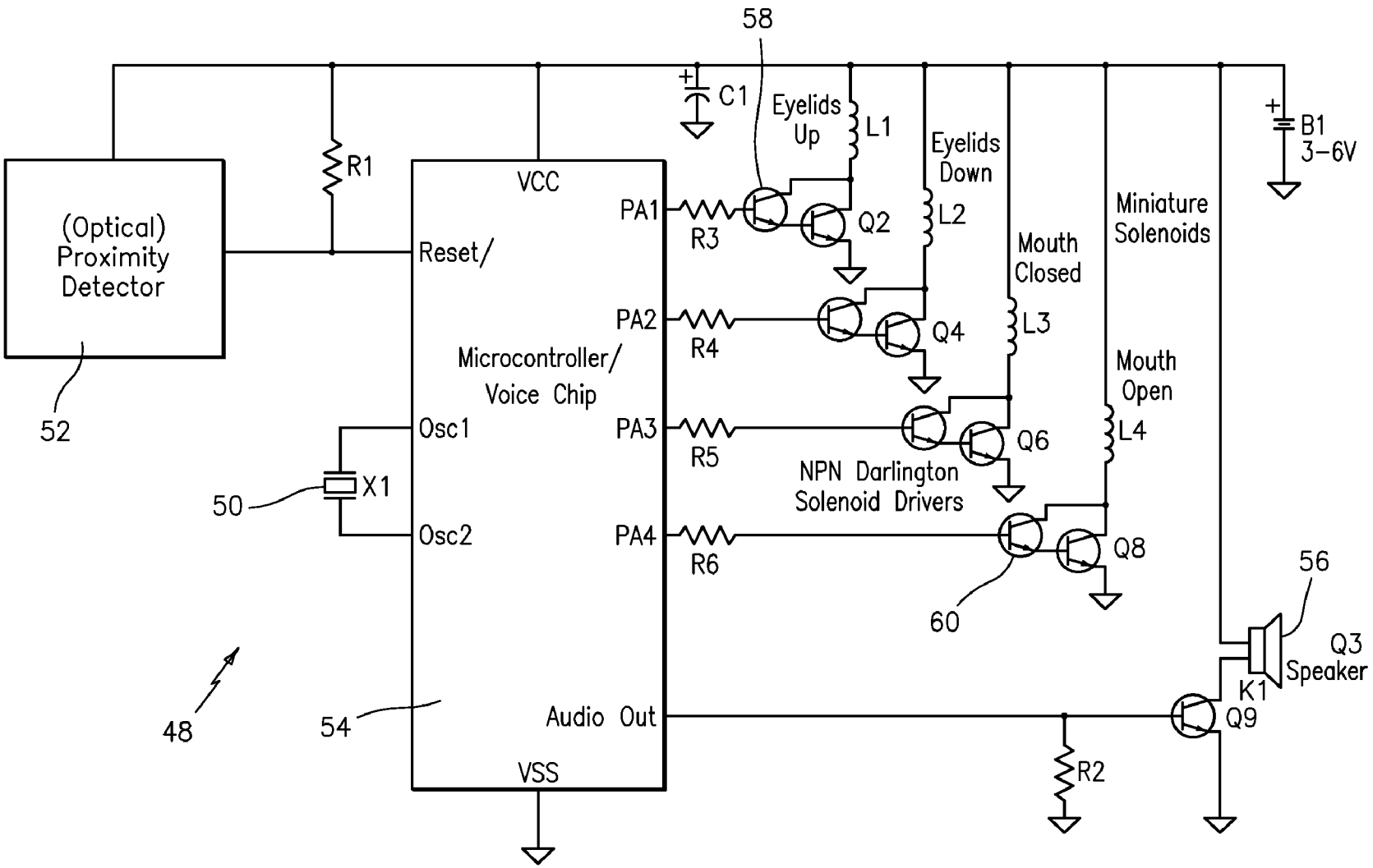
FIG. 8 is a schematic diagram of the electronics suitable for activating an animated photograph solenoid mechanism, including a voice chip for audio playback, and a proximity detector to trigger the animation mechanism.

FIG. 8 shows the electronic circuitry 48 employed in the preferred embodiment of the invention, which circuitry is powered by a battery. The circuitry 48 includes an optional proximity detector 52, microcontroller/voice chip 54, speaker 56, and transistor drivers 58, 60 for the eye and mouth solenoids 36-42. Any suitable proximity detector 52 may be used to trigger the animation mechanism 12 and playback of an audio file stored on the microcontroller/voice chip 54 through the speaker 56 whenever someone approaches the picture or photograph 14. It should be appreciated that various types of proximity detectors 52 may be used, such as infra-red or ultrasonic detectors for example. However, to minimize cost an optical sensor using a photocell that responds to visible light is preferred. The photocell detector detects small variations in incident light, such as a shadow cast by a person walking past the animated picture 10. If the animation mechanism 12 is used in a card or brochure, the proximity detector 52 is replaced by a mechanical pull-tab, photoconductive sensor, or other suitable means to trigger the animation mechanism when the brochure or card is opened.

Once triggered by the proximity detector 52, the microcontroller/voice chip 54 starts playback of the stored audio file through the speaker 56, and energizes the various solenoids 30 in accordance with a stored software program, to move the mouth and eyes of the picture in synchronization with the audio. There are several ways to achieve such synchronization. For example, low frequency control tones can be embedded into the audio and detected upon playback to trigger movement of the eyelids 16 and mouth 18, using different tones or different length tone bursts to differentiate control signals for the eyelids 16 and mouth 18. The preferred synchronization method, to minimize cost, is simply to incorporate time delays into the microcontroller 54 control program, so that while the audio playback is in progress, the microcontroller 54 generates a series of time delays, in sequence, and activates the appropriate solenoids 30 at pre-programmed time intervals and in a pre-programmed order.

Figure 7:
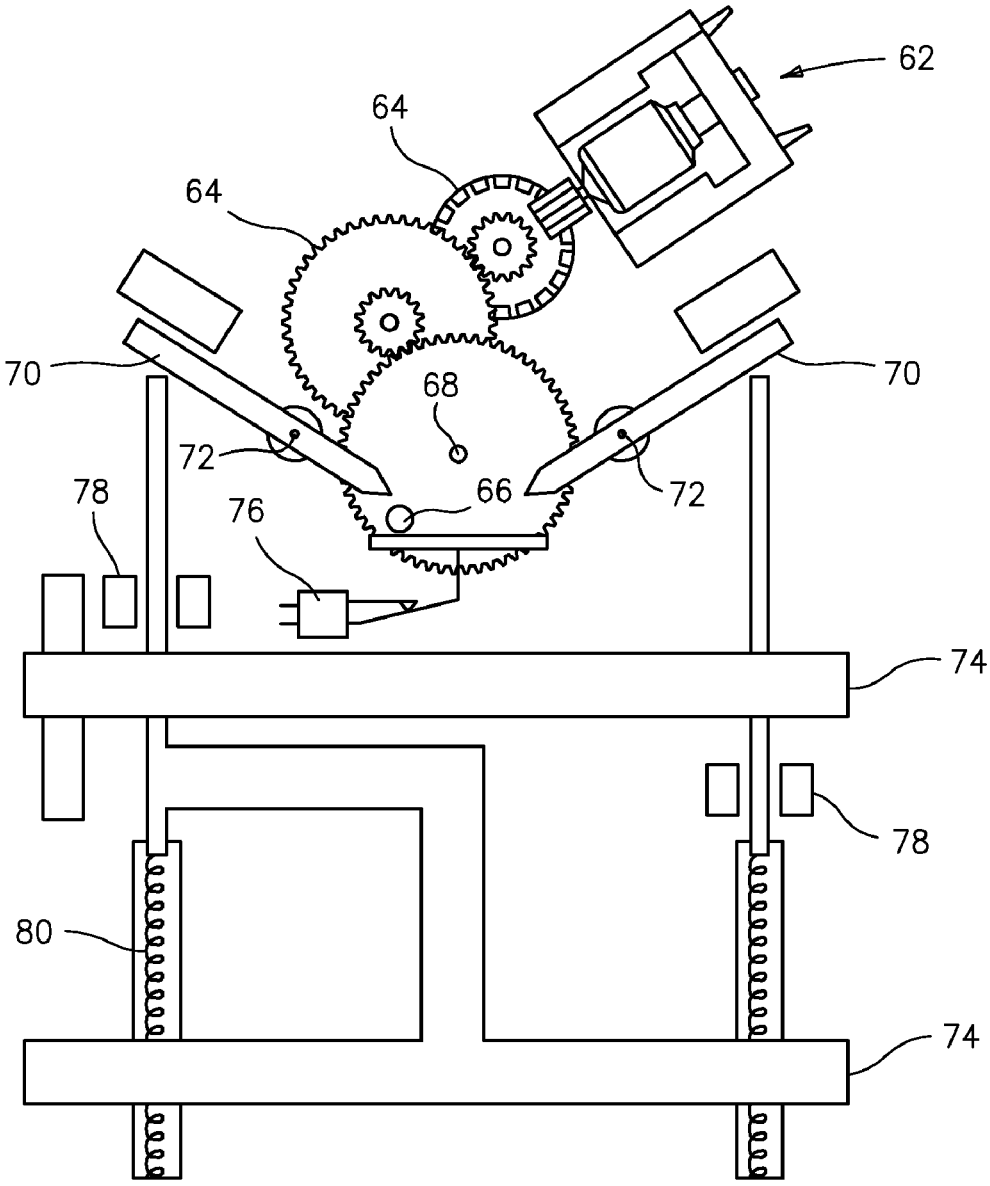
FIG. 7 is a rear view of a motor-driven mechanism, suitable for raising or lowering the eyes and mouth in a larger picture or portrait.
Figure 10:
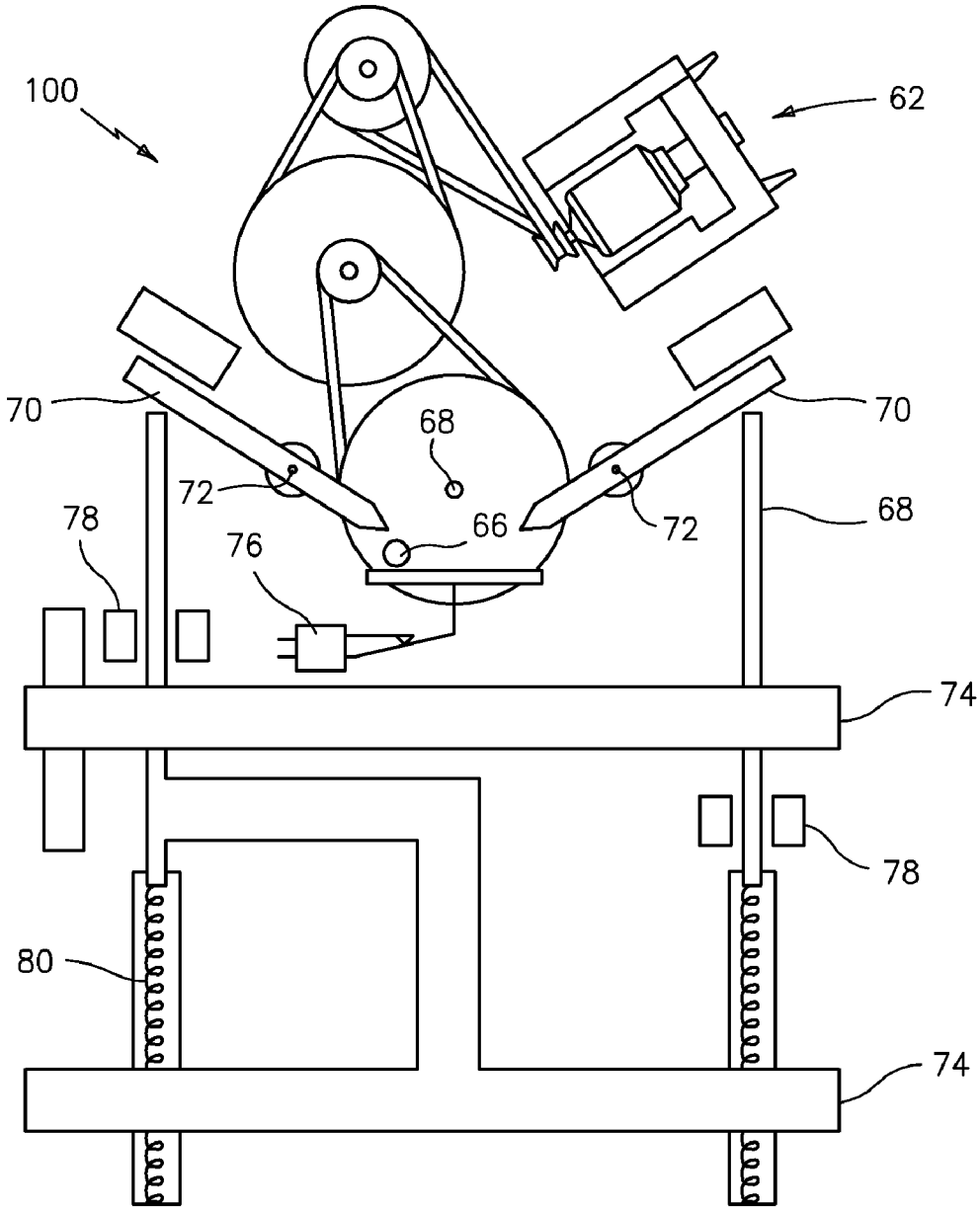
FIG. 10 is a rear view of a motor-driven belt and pulley mechanism, suitable for raising or lowering the eyes and mouth in a lager picture or portrait.

For larger pictures or photographs 14 where the eyelid and mouth/lip inserts 22, 24 are larger and thus heavier, more force or torque may be required to move the inserts 20 up and down than may be available from the tiny solenoids 30 described previously. If the size (diameter) of the solenoids 30 is increased to achieve greater pull capability by increasing the number of turns of the coils, the overall thickness of the animated photograph 10 may become too large to fit into a thin picture frame or card. To avoid this problem, an alternative animation mechanism 12 is contemplated, as illustrated in FIG. 7, using a single miniature open frame motor 62, mounted behind but in parallel with the plane of the picture 14. This motor 62 is speed reduced, through an appropriate gear train 64, or alternatively a belt and pulley system 100, as shown in FIG. 10, and used to rotate a pin 66 about a fixed shaft 68. As the pin 66 rotates it engages one of two pivot arms 70, depending upon the direction of rotation, which pivot about fixed anchors 72 and displace one of two moving arms 74 in a downward linear movement. Once the rotating pin 66 has completed a full revolution, it hits a limit switch 76 which turns off the motor 62 so that each time the motor 62 is activated, one of the two moving arms 74 (depending upon the direction of rotation) is moved a fixed distance. These moving arms 74 slide up and down between guides 78 and are spring-loaded so that as an arm 74 is moved downward, as previously described, a spring 80 is compressed which then returns the moving arm 74 to its normal position after the rotating pin 66 has passed by the associated pivot arm 70. The sliding moving arms 74 are attached to the eyelid and mouth/lip inserts 22, 24, behind the picture or photograph 14, so that as they move the inserts 20 move downward, causing the picture's eyelids 16 to close or the mouth 18 to open momentarily and then return to their upward position through the action of the springs 80.

Figure 9:
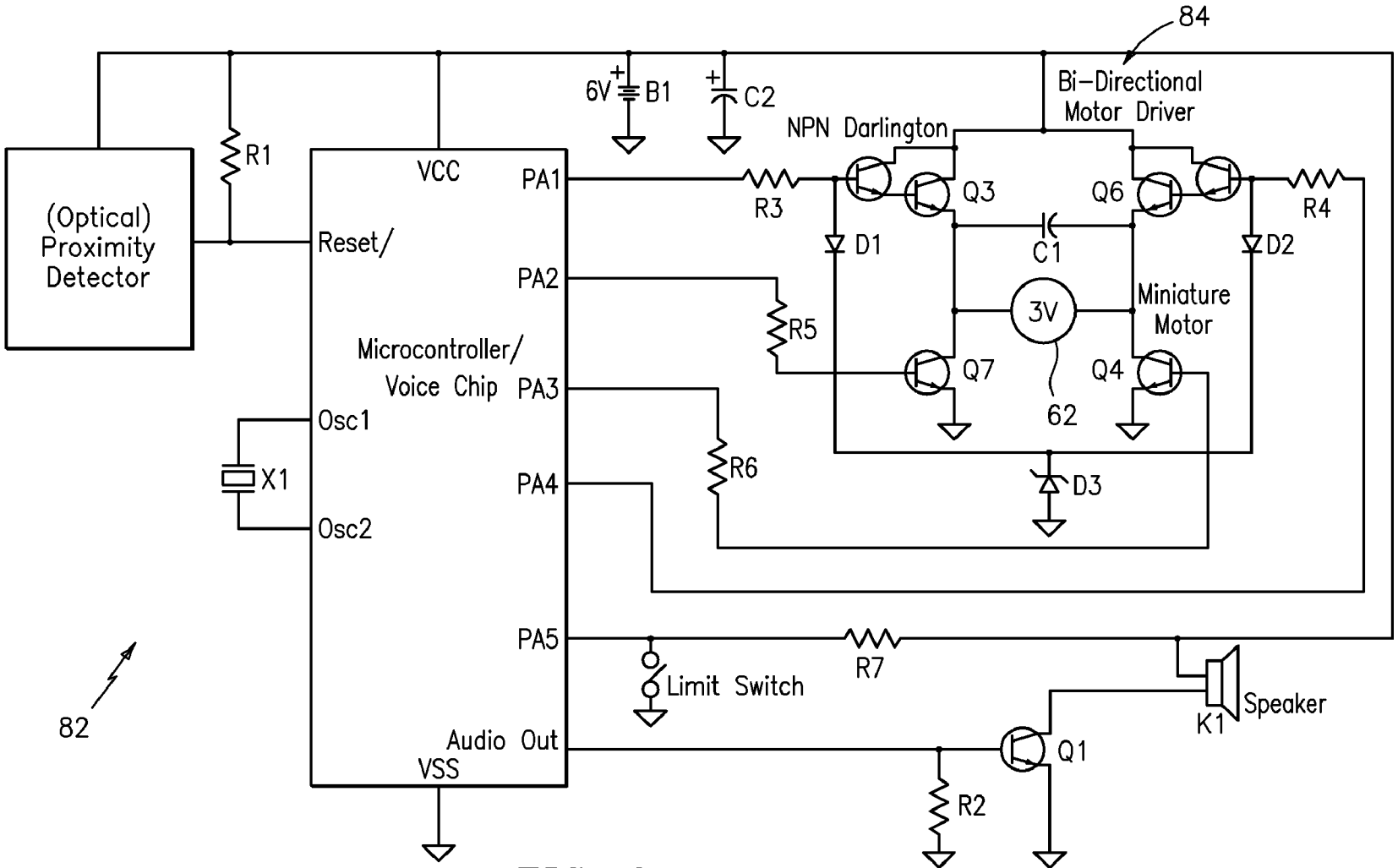
FIG. 9 is a schematic diagram of the electronics used to activate an animated photograph motor-driven mechanism, including a bi-directional motor driver which selects movement of either the eyes or mouth of the picture by changing the polarity of the applied motor voltage.

FIG. 9 shows the electronic circuitry 82 required to control the motor-driven picture animation mechanism 12. The operation of the proximity detector 52 and microcontroller/voice chip 54 is the same as described above for the solenoid-driven mechanism 12, except that the microcontroller 54 now controls the movement of the eyelids 16 and mouth 18 of the picture 14 by controlling a bidirectional motor driver 84 to energize the motor 62, in either direction, until the limit switch 76 is tripped.

It should be obvious to one skilled in the art that other methods of moving the eyelids and mouth/lip inserts 22, 24 of a picture or photograph 14 are also possible, including the use of magnets, or alloy wire, such as nickel-titanium wire, which shortens in length when electrically powered. Any other methods of displacing the facial features of a flat picture or photograph are within the scope of this invention. Similarly, the animation mechanism 12 of the present invention may also be used to animate other two-dimensional images or pictures in much the same manner as described herein for the movement of eyelids 16 and the mouth 18 of an individual featured in the picture 14. Furthermore, while such movement is described herein as being linear, rotational movement may also be imparted upon elements of the picture 14 simply by substituting some of the linkages described herein, or including lever arms or pivoted elements and the like. Likewise, there are a variety of proximity detectors 52 or other means for activating the apparatus 10 of the present invention, and the audio portion of the invention need not be limited to a prerecorded audio file on the microcontroller/voice chip 54. For example, recording means may be included to allow an individual to record a short audio clip, which audio file may be associated with the individual in the photo 14.

What is claimed is:

1. An apparatus for animating an image having at least one element thereof suitable for animation, said image being imprinted or otherwise disposed on a surface that is substantially flat in profile, said apparatus comprising:

at least one animation mechanism attached to said element, said animation mechanism being substantially flat in profile and including means for moving said element along a linear path, to thereby animate said image, said animation mechanism being situated in a parallel disposition immediately adjacent to the side of said substantially flat surface opposite said image so as not to significantly increase the profile of said surface;

wherein said element is physically separate from said image and said flat surface, said element including a continuation of said image disposed thereon, wherein said continuation of said image includes at least two representations for providing the illusion of animation to said image when said element is moved by said animation mechanism;

wherein said animation mechanism comprises a pair of solenoids attached to said element, wherein one of said pair of solenoids is disposed to move said element in one linear direction, and wherein the other of said pair of solenoids is disposed to move said element in an opposite linear direction.

2. The apparatus of claim 1, wherein said flat surface includes at least one slit therein, and wherein a portion of said element is inserted through said slit such that at least one of said representations on said element is visible over said image and wherein said second representation is disposed behind said flat surface.

3. The apparatus of claim 2, further including means for guiding the movement of said element.

4. An apparatus as in claim 1 further comprising wherein said element is physically separate from said image and said flat surface, said element including a continuation of said image disposed thereon, wherein said element is movable between a hidden first position and a visible second position, whereby each position presents a differing visual image, providing the illusion of animation to said image when said element is moved by said animation mechanism.

5. The apparatus of claim 1, further including means for playing an audio file associated with said image.

6. The apparatus of claim 5, further including means for synchronizing said animation mechanism with said means for playing.

7. The apparatus of claim 6, wherein said means for playing and said means for synchronizing comprises a microcontroller/voice chip and a speaker connected thereto.

8. The apparatus of claim 7, wherein said microcontroller/voice chip and said animation mechanism are powered by a battery.

9. An apparatus for animating an image having at least one element thereof suitable for animation, said image being imprinted or otherwise disposed on a surface that is substantially flat in profile, said apparatus comprising:

at least one animation mechanism attached to said element, said animation mechanism being substantially flat in profile and including means for moving said element along a linear path, to thereby animate said image, said animation mechanism being situated in a parallel disposition immediately adjacent to the side of said substantially flat surface opposite said image so as not to significantly increase the profile of said surface;

wherein said animation mechanism comprises a pair of solenoids attached to each of said elements, wherein one of said pair of solenoids is disposed to move said element in one linear direction, and wherein the other of said pair of solenoids is disposed to move said element in an opposite linear direction.

10. An apparatus as in claim 9 further comprising wherein said element is physically separate from said image and said flat surface, said element including a continuation of said image disposed thereon, wherein said element is movable between a hidden first position and a visible second position, whereby each position presents a differing visual image, providing the illusion of animation to said image when said element is moved by said animation mechanism.

11. The apparatus of claim 9, further including means for playing an audio file associated with said image.

12. The apparatus of claim 11, further including means for synchronizing said animation mechanism with said means for playing.

13. The apparatus of claim 12, wherein said means for playing and said means for synchronizing comprises a microcontroller/voice chip and a speaker connected thereto.

14. The apparatus of claim 13, wherein said microcontroller/voice chip and said animation mechanism are powered by a battery.

15. An apparatus for animating an image having at least one element thereof suitable for animation. said image being imprinted or otherwise disposed on a surface that is substantially flat in profile. said apparatus comprising:

at least one animation mechanism attached to said element, said animation mechanism being substantially flat in profile and including means for moving said element to thereby animate said image, said animation mechanism being situated in a parallel disposition immediately adjacent to the side of said substantially flat surface opposite said image so as not to significantly increase the profile of said surface;

wherein said animation mechanism comprises a motor;

further including a gear train or belt and pulley system for increasing and transferring, the torque provided by said motor;

further including a pin attached to a gear in said gear train, or to a pulley in said belt and pulley system, said pin engaging a pivot arm for moving said element linearly, depending upon the polarity of voltage applied to said motor; and further including a limit switch which constrains movement of said pin to one rotation each time said motor is energized.

16. The apparatus of claim 15, further including at least one spring to return said element to its idle position after displacement by the action of said pivot arm.

17. An apparatus as in claim 15 further comprising wherein said element is physically separate from said image and said flat surface, said element including a continuation of said image disposed thereon, wherein said element is movable between a hidden first position and a visible second position, whereby each position presents a differing visual image, providing the illusion of animation to said image when said element is moved by said animation mechanism.

18. The apparatus of claim 15, further including means for playing an audio file associated with said image.

19. The apparatus of claim 18, further including means for synchronizing said animation mechanism with said means for playing.

20. The apparatus of claim 19, wherein said means for playing and said means for synchronizing comprises a microcontroller/voice chip and a speaker connected thereto.

21. The apparatus of claim 20, wherein said microcontroller/voice chip and said animation mechanism are powered by a battery.

22. An apparatus for animating an image having at least one element thereof suitable for animation, said image being imprinted or otherwise disposed on a substantially flat surface, wherein said element is physically separate from said image and said flat surface, said element including a continuation of said image disposed thereon, said apparatus comprising:

at least one animation mechanism attached to said element, said animation mechanism being substantially flat in profile and including means for moving said element along a linear path to thereby animate said image, said animation mechanism being situated in a parallel disposition immediately adjacent to the side of said substantially flat surface opposite said image so as not to significantly increase the profile of said surface, wherein said continuation of said image includes at least two representations for providing the illusion of animation to said image when said element is moved by said animation mechanism, wherein said animation mechanism comprises a pair of solenoids attached to said element, wherein one of said pair of solenoids is disposed to move said element in one linear direction, and wherein the other of said pair of solenoids is disposed to move said element in an opposite linear direction;

wherein said flat surface includes at least one slit therein, and wherein a portion of said element is inserted through said slit such that at least one of said representations on said element is visible over said image and wherein said hidden portion is disposed behind said flat surface;

means for playing an audio file associated with said image; and means for synchronizing said animation mechanism with said means for playing, wherein said means for playing and said means for synchronizing comprises a microcontroller/voice chip and a speaker connected thereto, and further wherein said microcontroller/voice chip and said animation mechanism are powered by a battery.

23. A method for animating an image having at least one movable element thereof suitable for animation, said image being imprinted or otherwise disposed on a substantially flat surface, wherein said element is physically separate from said image and said flat surface, said element including a continuation of said image disposed thereon, said method comprising:

providing at least one animation mechanism operably attached to said element, said animation mechanism being substantially flat in profile and including means for moving said element along a linear path, to thereby animate said image, situating said animation mechanism in a parallel disposition immediately adjacent to the side of said substantially flat surface opposite said image so as not to significantly increase the profile of said surface, wherein said continuation of said image includes at least two representations for providing the illusion of animation to said image when said element is moved by said animation mechanism, wherein said animation mechanism comprises a pair of solenoids attached to said element, wherein one of said pair of solenoids is disposed to move said element in one linear direction, and wherein the other of said pair of solenoids is disposed to move said element in an opposite linear direction;

wherein said flat surface includes at least one slit therein, and wherein a portion of said element is inserted through said slit such that at least one of said representations on said element is visible over said image and wherein said hidden portion is disposed behind said flat surface;

playing an audio file associated with said image; and synchronizing said animation motion with said playing, wherein said means for playing and said means for synchronizing comprises a microcontroller/voice chip and a speaker connected thereto, and further wherein said microcontroller/voice chip and said animation mechanism are powered by a battery.

* * * * *